US005257171A

United States Patent [19]

Hara

[11] Patent Number: 5,257,171

[45] Date of Patent: Oct. 26, 1993

[54] ELECTRIC CONTROL APPARATUS FOR DISHWASHING MACHINE

[75] Inventor: Yasuo Hara, Shimane, Japan

[73] Assignee: Hoshizaki Denki Kabushiki Kaisha, Aichi, Japan

[21] Appl. No.: 836,440

[22] Filed: Feb. 18, 1992

[30] Foreign Application Priority Data

Feb. 15, 1991 [JP] Japan ..... 3-044343

[51] Int. Cl.[5] ..... G06F 15/46; G05B 19/04

[52] U.S. Cl. ..... 364/143; 134/57 D; 364/400

[58] Field of Search ..... 364/140, 141, 143, 144, 364/146, 400; 134/57 R, 57 D, 58 R, 58 D, 18

[56] References Cited

U.S. PATENT DOCUMENTS

| | | | |
|---|---|---|---|
| 4,245,310 | 1/1981 | Kiefer | 134/57 D X |
| 4,418,398 | 11/1983 | Hornung | 364/146 X |
| 4,467,423 | 8/1984 | Smith et al. | 134/57 D X |
| 5,006,767 | 4/1991 | Maruyama et al. | 134/57 D X |
| 5,017,852 | 5/1991 | Nagata et al. | 134/57 D X |

*Primary Examiner*—Joseph Ruggiero
*Attorney, Agent, or Firm*—Nikaido, Marmelstein, Murray & Oram

[57] ABSTRACT

An electric control apparatus for a dishwashing machine for controlling the supply and discharge of hot water into and from a wash water storage tank in the machine prior to washing operation. The electric control apparatus is designed to supply hot water into the wash tank from a supply source of hot water in response to operation of a power source switch and maintain the supply of hot water into the wash tank during first and second predetermined times, to discharge the hot water from the wash tank upon lapse of the first predetermined time and maintain the discharge of hot water during the second predetermined time, to interrupt the supply and discharge of hot water into and from upon lapse of the second predetermined time and maintain the interruption of the supply and discharge of hot water during a third predetermined time, and to discharge the hot water from the wash tank upon lapse of the third predetermined time and maintain the discharge of hot water during a fourth predetermined time.

3 Claims, 7 Drawing Sheets

ELECTRIC CONTROL APPARATUS FOR DISHWASHING MACHINE

BACKGROUND OF THE INVENTION

1. Field of the Invention

The present invention relates to a dishwashing machine, and more particularly to an electric control apparatus for controlling the supply and discharge of hot water into and from a wash tank in the dishwashing machine prior to washing operation.

2. Description of the Prior Art

In a conventional dishwashing machine disclosed in Japanese Patent Laid-open Publication No. 63-264036, an electrically operated water supply valve is disposed within a water supply pipe in connection to a supply source of hot water to be opened in response to operation of a power source switch for permitting hot water supplied into a wash tank from the supply source of hot water through the water supply pipe prior to washing operation. In this kind of dishwashing machine, the hot water remained in the water supply pipe after stopping of the machine is cooled and becomes cold water. When the water supply valve is opened by operation of the power source switch to supply fresh hot water into the wash tank from the supply source of hot water, the cold water in the water supply pipe flows with the supplied hot water into the wash tank. As a result, the hot water from the supply source may not be stored in the wash tank at a high temperature suitable for washing operation of the machine.

To solve the above problem, there has been proposed an electric control apparatus for the dishwashing machine which is designed to supply hot water into the wash tank from the supply source of hot water in response to operation of the power source switch during a first predetermined time, to discharge the hot water from the wash tank upon lapse of the first predetermined time and maintain the supply and discharge of hot water during a second predetermined time and to interrupt the supply of hot water into the wash tank upon lapse of the second predetermined time and maintain the discharge of hot water from the wash tank during a third predetermined time.

In the case that a small size water heater or boiler is adapted to the supply source of hot water, however, the supply amount of hot water into the wash tank inevitably decreases. Particularly in winter, the supply amount of hot water is noticeably decreased to maintain the temperature of hot water at a high temperature suitable for washing operation. In such a case, the hot water stored in the wash tank during the first predetermined time is fully discharged in a short period of time during the second predetermined time. If the discharge pump of the dishwashing machine sucks the air from the wash tank due to shortage of the hot water stored therein in the course of lapse of the second predetermined time, the discharge performance of the pump becomes lower or ineffective. As a result, the hot water supplied from the water heater in the course of lapse of the second predetermined time is stored and remained in the wash tank at a low temperature after lapse of the third predetermined time. If in such a condition the operation switch of the machine is operated to start washing operation, the low temperature hot water remained in the wash tank is mixed with fresh hot water newly supplied from the water heater for washing. This results in poor washing of tableware racked in the machine.

If the user leaves the dishwashing machine unattended after operation of the power source switch and returns to operate the operation switch of the machine after lapse of the third predetermined time, the hot water remained in the water supply pipe will be cooled by the ambient temperature. Even if in such a condition the operation switch is operated to start washing operation of the machine, the cooled hot water in the water supply pipe will be mixed with fresh hot water supplied from the water heater for washing. This also results in poor washing of the tableware racked in the machine. To avoid such a problem, the user has to attend to the dishwashing machine until the third predetermined time lapses.

SUMMARY OF THE INVENTION

It is, therefore, a primary object of the present invention to provide an electric control apparatus for the dishwashing machine capable of completely discharging the low temperature hot water from the wash tank to store fresh hot water newly supplied into the wash tank from the supply source of hot water at a high temperature suitable for washing operation.

A secondary object of the present invention is to provide an electric control apparatus for the dishwashing machine, capable of storing fresh hot water supplied into the wash tank for washing operation at a high temperature even if the user leaves the machine unattended.

According to the present invention, the primary object is attained by providing an electric control apparatus for a dishwashing machine having a washing chamber, a water supply pipe arranged to supply hot water from a supply source of hot water into the washing chamber, an electrically operated water supply valve disposed within the water supply pipe to permit the supply of hot water into the washing chamber therethrough when activated, a wash tank arranged to be supplied with the hot water through the washing chamber, a wash pump arranged to pump up the hot water from the wash tank when activated, a revolving wash arm arranged within the washing chamber to direct jet streams of the hot water supplied from the wash pump to a rack of tableware placed in the washing chamber, and a discharge pump arranged to discharge the hot water from the wash tank, which control apparatus comprises a power source switch; means for successively measuring first, second, third and fourth predetermined times in response to operation of the power source switch; means for activating the water supply valve in response to operation of the power source switch to supply hot water into the wash tank from the supply source of hot water through the water supply pipe and the washing chamber during the first and second predetermined times; means for activating the discharge pump upon lapse of the first predetermined time to discharge the hot water from the wash tank during the second predetermined time; means for deactivating the water supply valve and the discharge pump upon lapse of the second predetermined time and maintaining the water supply valve and the discharge pump at their deactivated conditions during the third predetermined time; and means for activating the discharge pump upon lapse of the third predetermined time to discharge the hot water from the wash tank during the fourth predetermined time and deactivating the discharge pump upon lapse of the fourth predetermined time, an electric control apparatus for a dishwashing machine.

BRIEF DESCRIPTION OF THE DRAWINGS

Additional objects, features and advantages of the present invention will be more readily appreciated from the following detailed description of certain preferred embodiments thereof when taken together with the accompanying drawings, in which.

DESCRIPTION OF THE PREFERRED EMBODIMENTS

Figure 1:
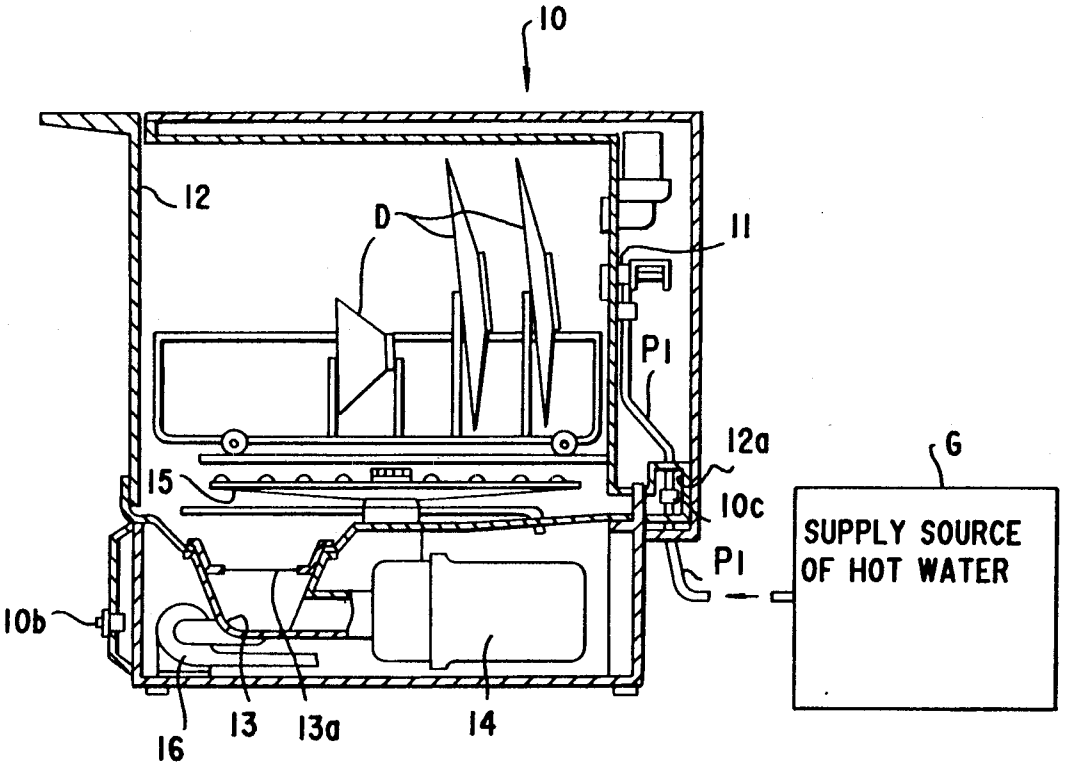
FIG. 1 is a schematic sectional view of a dishwashing machine.

Referring now to the drawings, FIG. 1 schematically illustrates a dishwashing machine which includes a box-type housing 10 forming therein a washing chamber 12 to be supplied with hot water from a supply source of hot water G through a water supply pipe $P_1$ and an electrically operated water supply valve 11, a wash tank 13 provided at the bottom of washing chamber 12 to store the hot water supplied from the washing chamber 12 through a filter 13*a*, a wash pump 14 connected to the wash tank 13 to pump up the stored hot water therefrom, a revolving wash arm 15 arranged within the washing chamber 12 to direct powerful jet streams of the hot water supplied thereto from the wash pump 14 to a rack of tableware D, and a discharge pump 16 connected to the bottom of wash tank 13 to discharge the hot water from the wash tank 13.

In this embodiment, the supply source of hot water G is in the form of a small size water heater or a small size boiler which is arranged to heat fresh water from a water supply source (not shown) up to a predetermined high temperature and to maintain the supply amount of hot water at the predetermined high temperature in accordance with the outside temperature. The discharge pump 16 is constructed to suck the hot water from wash tank 13 and compress it for discharge. When sucking the air due to decrease of the hot water in wash tank 13, the discharge pump does not effect to discharge hot water newly supplied into the wash tank 13.

Figure 2:
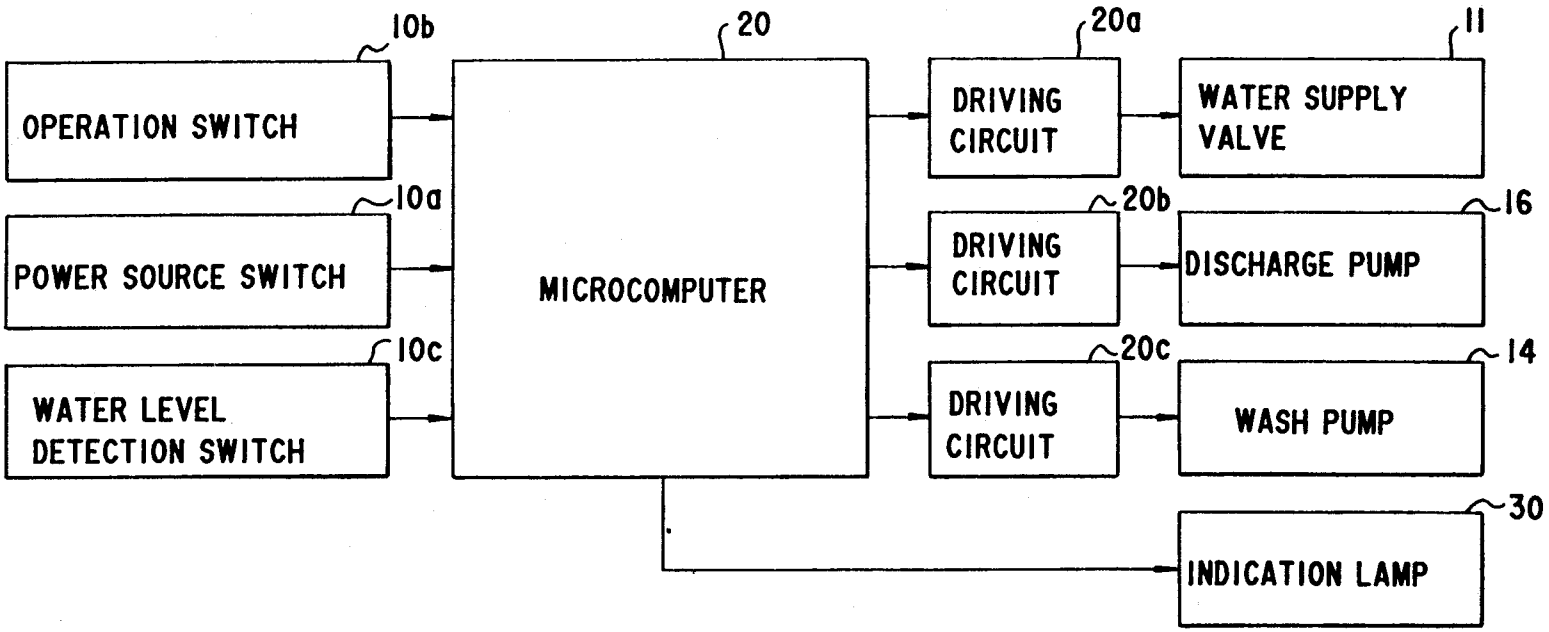
FIG. 2 is a block diagram of an electric control apparatus for the dishwashing machine.

As shown in FIG. 2, an electric control apparatus for the dishwashing machine includes a microcomputer 20 connected at its input to a power source switch 10*a*, an operation switch 10*b* and a water level detection switch 10*c* and at its output to a solenoid of water supply valve 11 and each electric motor of the wash pump 14 and discharge pump 16 through driving circuits 20*a*, 20*c*, 20*b* and to an indication lamp 30. The power source switch 10*a* is operated to supply a direct-current voltage to the computer 20 from a direct-current source and to supply an electric power from an alternating current source to the solenoid of water supply valve 11 and the respective electric motors of the wash pump 14 and discharge pump 16. As shown in FIG. 1, the operation switch 10*b* is mounted to a lower portion of a front panel of the housing 10 to issue an operation signal therefrom when operated to start washing operation of the machine.

As shown in FIG. 1, the water level detection switch 10*c* is arranged within a small chamber 12 formed in a bottom portion of the washing chamber 12 to issue a water level signal therefrom when the detected rise of the hot water surface in the bottom of washing chamber 12 is up to a predetermined level. The computer 20 cooperates with the switches 10*a*–10*c* to execute a control program shown by a flow chart in FIG. 3 for applying control signals to the driving circuits 20*a*–20*c* and indication lamp 30. The computer 20 has a read-only memory or ROM for preliminarily memorizing the control program, and the indication lamp 30 is arranged to inform the user of a washable condition of the dishwashing machine when it has been lighted.

Figure 3:
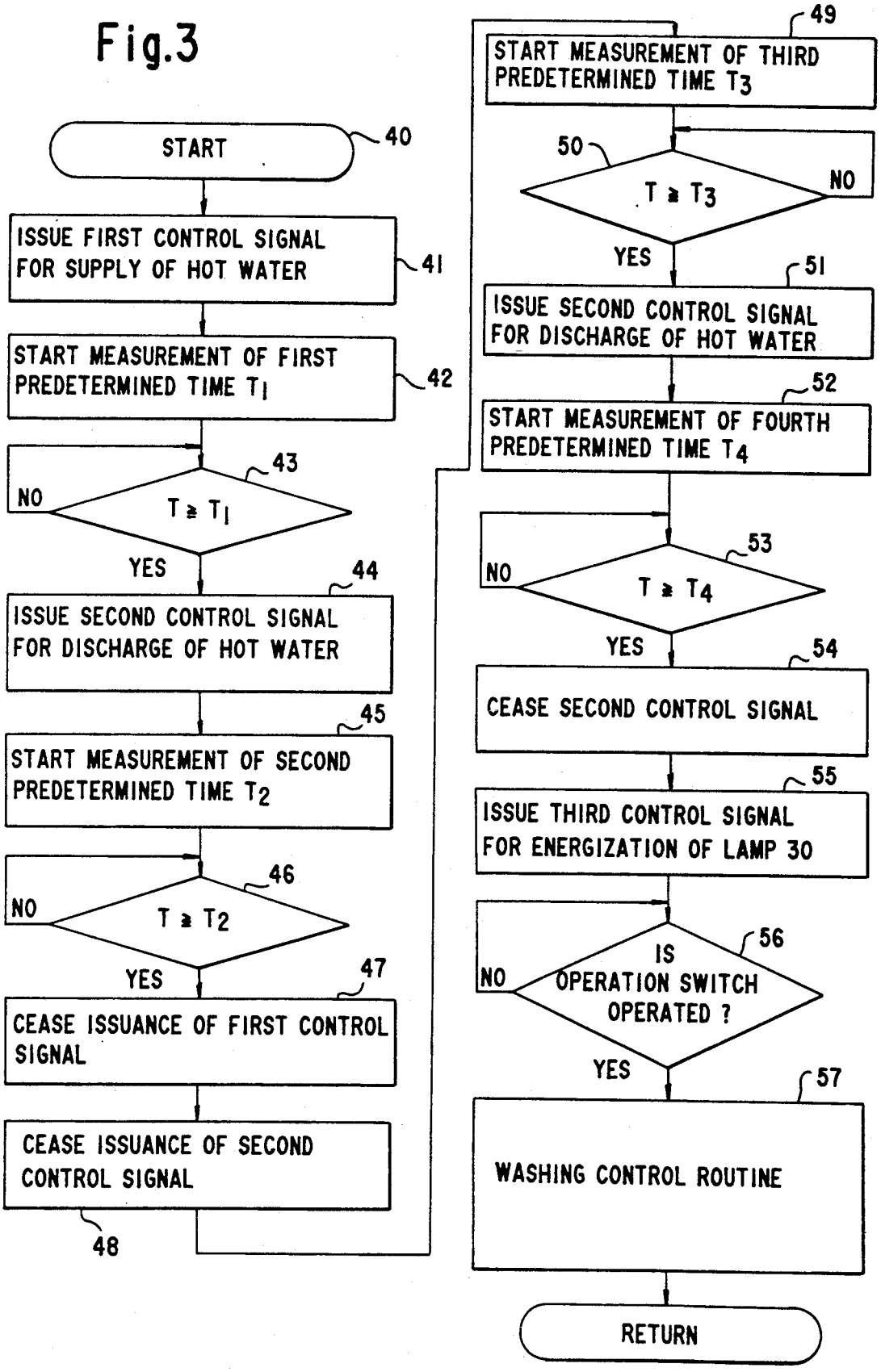
FIG. 3 is a flow chart of a control program executed by a microcomputer shown in FIG. 2.

Assuming that the power source switch 10*a* has been operated, the computer 20 initiates execution of the control program at step 40 shown in FIG. 3. The computer 20 issues a first control signal for activation of the water supply valve 11 at step 41 and resets a timer provided therein at step 42 to start it for measurement of a first predetermined time $T_1$ (for instance, 7 seconds). When applied with the first control signal from computer 20, the driving circuit 20*a* energizes the solenoid of water supply valve 11. Thus, the water supply valve 11 is opened by energization of its solenoid to supply hot water from the supply source of hot water G into the washing chamber 12 therethrough, and in turn, the hot water flows into the wash tank 13 from the washing chamber 12 through the filter 13. During measurement of the first predetermined time $T_1$, the computer 20 determines a "No" answer at step 43, and the wash tank 13 is supplied with an amount of hot water sufficient for preventing suction of the air into the discharge pump 16. In this instance, the cold water remaining in the water supply pipe $P_1$ is discharged with the supplied hot water and stored in the wash tank 13.

Upon lapse of the first predetermined time $T_1$, the computer 20 determines a "Yes" answer at step 43 and causes the program to proceed to step 44. At step 44, the computer 20 issues a second control signal for activation of the discharge pump 16. When applied with the second control signal from computer 20, the driving circuit 20*b* energizes the electric motor of discharge pump 16. Thus, the discharge pump 16 is operated by energization of its electric motor to discharge the hot water from wash tank 13. In this instance, the discharge of hot water is conducted without causing any suction of the air into the discharge pump 16.

After processing at step 44, the computer 20 resets the timer at step 45 to restart it for measurement of a second predetermined time $T_2$. During measurement of the second predetermined time $T_2$, the computer 20 determines a "No" answer at step 46. In this embodiment, the second predetermined time $T_2$ is memorized in the ROM of computer 20 as period of time (for instance, 23 seconds) during which the low temperature hot water mixed with the cold water from pipe $P_1$ is discharged from wash tank 13 to store fresh hot water newly supplied into wash tank 13 at a high temperature suitable for washing of the tableware D. Upon lapse of the second predetermined time $T_2$, the computer 20 determines a "Yes" answer at step 46 and causes the program to proceed to step 47. Thus, the computer 20 ceases the issuance of the first control signal at step 47 and ceases the issuance of the second control signal at step 48. In response to disappearance of the control signals, the water supply valve 11 is closed by deenergization of its solenoid to interrupt the supply of hot water into the washing chamber 12, and the discharge pump 16 is stopped to maintain the hot water stored in wash tank 13 at the high temperature.

At the following step 49, the computer 20 resets the timer to restart it for measurement of a third predetermined time $T_3$. During measurement of the third predetermined time $T_3$, the computer 20 determines a "No" answer at step 50. In this embodiment, the third predetermined time $T_3$ is memorized in the ROM of computer 20 as a period of time (for instance, 3 seconds) during which the air sucked into the discharge pump 16 during the second predetermined time $T_2$ is exhausted by the hot water further supplied into wash tank 13 before stopping of the discharge pump 16. Upon lapse of the third predetermined time T3, the computer 20 determines a "Yes" answer at step 50 and causes the program to proceed to step 51. At step 51, the computer 20 issues again the second control signal for activation of the discharge pump 16. When applied with the second control signal from computer 20, the driving circuit **20*b* energizes the electric motor of discharge pump 16. Thus, the discharge pump 16 is operated again by energization of its electric motor to discharge the hot water from wash tank 13 through the discharge pipe. In this instance, the discharge of hot water is smoothly conducted without causing any suction of the air into the discharge pump 16 since the air is exhausted from the discharge pump 16** during the third predetermined time $T_3$.

After processing at step 51, the computer 20 resets the timer at step 52 to restart it for measurement of a fourth predetermined time $T_4$. During measurement of the fourth predetermined time $T_4$, the computer 20 determines a "No" answer at step 53 to maintain the operation of discharge pump 16. In this embodiment, the fourth predetermined time $T_4$ is memorized in the ROM of computer 20 as a period of time (for instance, 10 seconds) during which the low temperature hot water remained in wash tank 13 is completely discharged to store hot water newly supplied into the wash tank 13 at the high temperature suitable for washing of the tableware D. Upon lapse of the fourth predetermined time T4, the computer 20 determines a "Yes" answer at step 53 and causes the program to proceed to step 54. Thus, the computer 20 ceases the issuance of the second control signal at step 54 and issues a third control signal for energization of the indication lamp 30 at step 55. When applied with the third control signal from computer 20, the indication lamp 30 is lighted to inform the user of a washable condition of the machine.

When the operation switch **10*b* is closed by the user to start washing operation of the machine under the above condition, the computer 20 determines a "Yes" answer at step 56 and causes the program to proceed to a washing control routine 57. During execution of the washing control routine 57, the water supply valve 11 is operated under control of the water level detection switch 10*c* to newly supply fresh hot water into the wash tank 13 from the supply source of hot water G through the washing chamber 12 at the high temperature. Thus, the tableware D such as soiled dishes racked in the washing chamber 12 are cleanly washed by powerful jet streams of the high temperature hot water under operation of the wash pump 14**.

Figure 4:
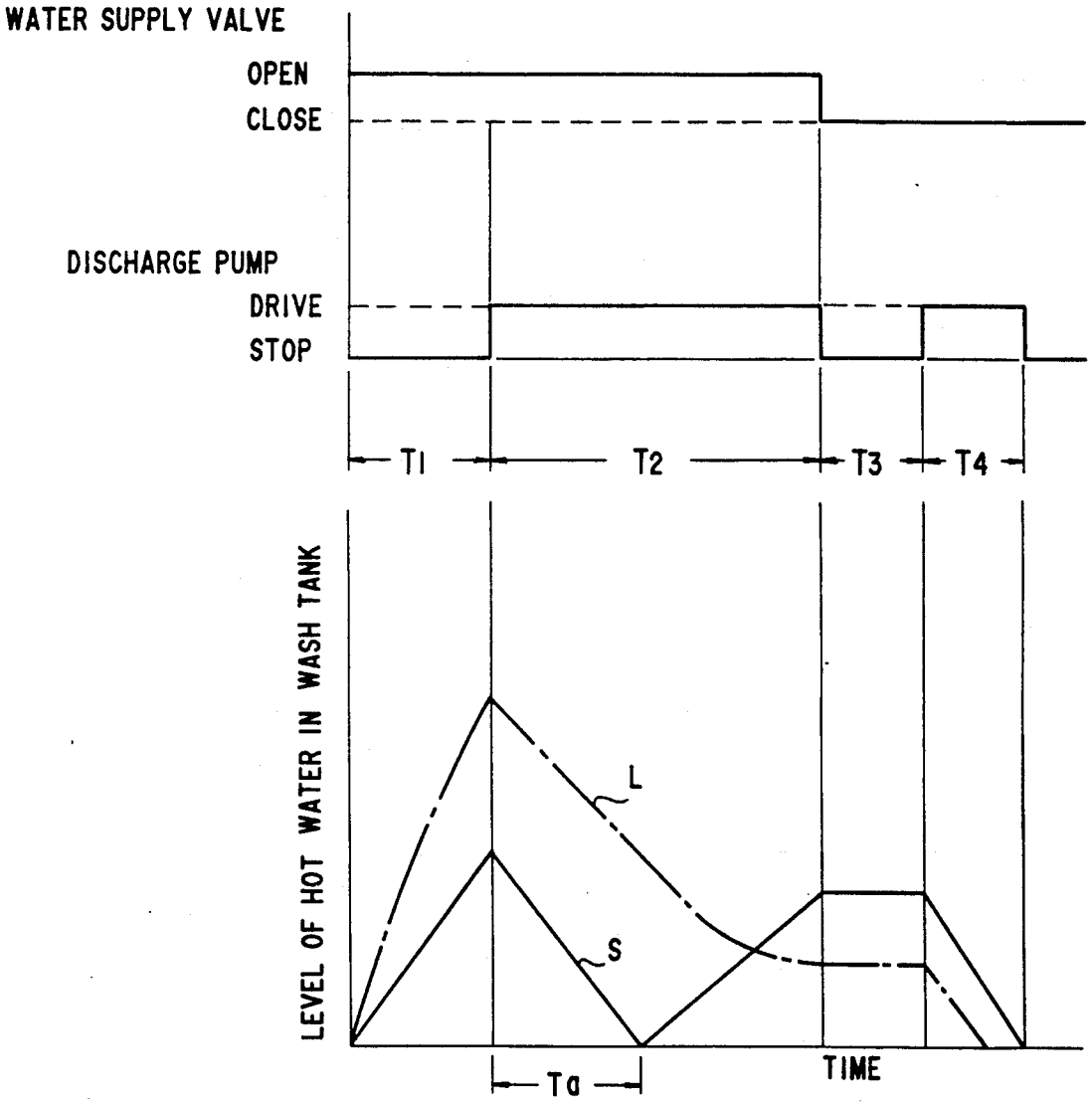
FIG. 4 is a time chart showing operation of a water supply valve and a discharge pump and the level of hot water in a wash tank in relation to lapse of time.

As is understood from the above description, the water supply valve 11 is opened by operation of the power source switch **10*a* and maintained in its open position during the first predetermined time $T_1$ as shown in FIG. 4 to supply the hot water from the source of hot water G into the wash tank 13 through the washing chamber 12. In this instance, the cold water remaining in the supply pipe P1 is discharged by the supplied hot water and flows into the wash tank 13 through the washing chamber 12. Subsequently, the water supply valve 11 is further maintained in its open position during the second predetermined time $T_2$ to continue the supply of hot water into the wash tank 13, while the discharge pump 16 is operated during the second predetermined time $T_2$ to discharge the low temperature hot water mixed with the cold water from wash tank 13**.

Upon lapse of the second predetermined time $T_2$, the water supply valve 11 is closed and maintained in its closed position during the third predetermined time $T_3$ while the discharge pump 16 is stopped during the third predetermined time $T_3$. Upon lapse of the third predetermined time $T_3$, the discharge pump 16 is operated to discharge the hot water from wash tank 13 during the fourth predetermined time $T_4$ while the water supply valve 11 is maintained in its closed position during the fourth predetermined time $T_4$. With such control of the water supply valve 11 and discharge pump 16, all the supplied hot water is discharged from the wash tank 13 to store hot water newly supplied into the wash tank 13 from the supply source of hot water G at the high temperature suitable for washing of the tableware D.

In the course of discharge of the hot water from wash tank 13 during the second predetermined time $T_2$, the hot water stored in wash tank 13 rapidly decreases during a short period of time $T_a$ as shown by a solid line S in FIG. 4 since the supply performance of hot water is smaller than the discharge performance of the pump 16. When the level of hot water in wash tank 13 becomes zero, the discharge pump 16 sucks the air from wash tank 13. Due to the air sucked therein, the discharge pump 16 does not effect to discharge hot water further supplied into the wash tank 13. As a result, an amount of hot water is stored in the wash tank 13 before stopping of the discharge pump 16. During the third predetermined time $T_3$, the air sucked into the discharge pump 16 is exhausted by the stored hot water in wash tank 13. Thus, the discharge of hot water from wash tank 13 in the course of lapse of the fourth predetermined time $T_4$ is smoothly conducted without causing any suction of the air into the discharge pump 16. Thereafter, the washable condition of the machine can be confirmed by lighting of the indication lamp 30, and the operation switch **10*b* is operated to start washing operation of the machine. In the case that the supply source of hot water G is in the form of a large size water heater, the level of hot water in wash tank 13 under control of the water supply valve 11 and discharge pump 16 changes as shown by a dot-dash line L in FIG. 4**.

Figure 5:
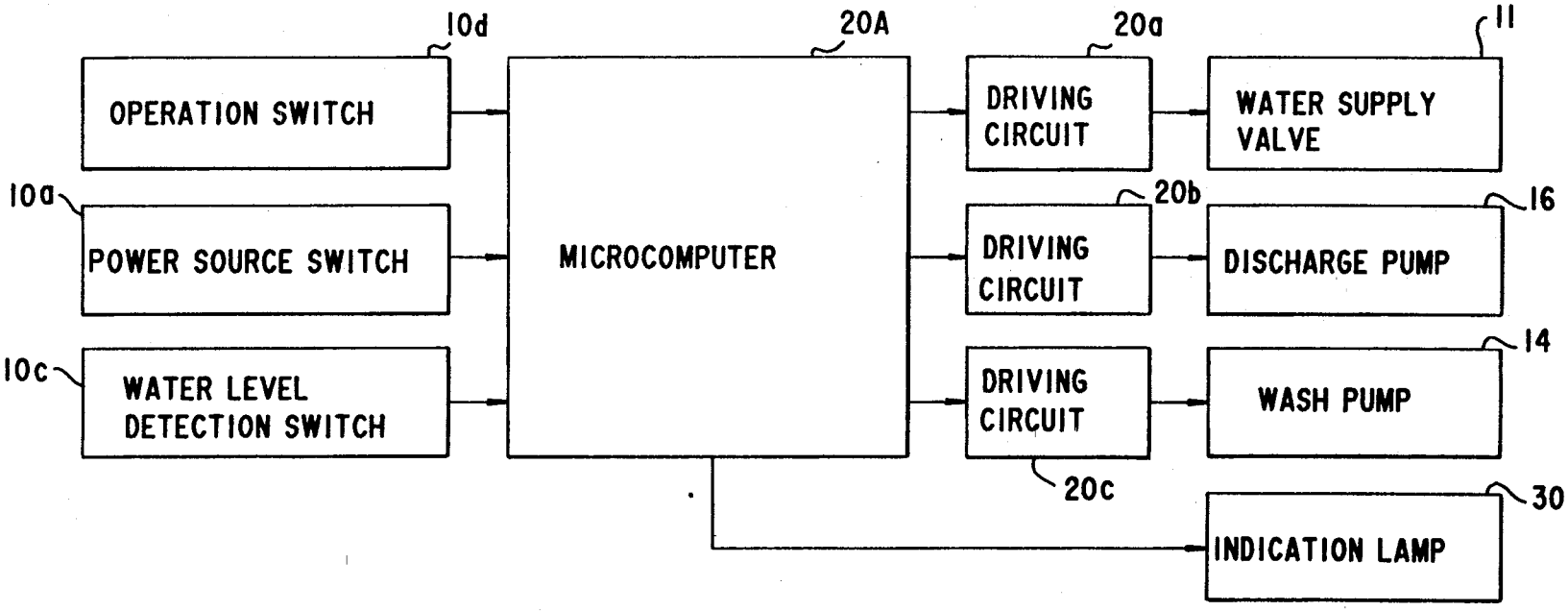
FIG. 5 is a block diagram of a modification of the electric control apparatus shown in FIG. 2.
Figure 6:
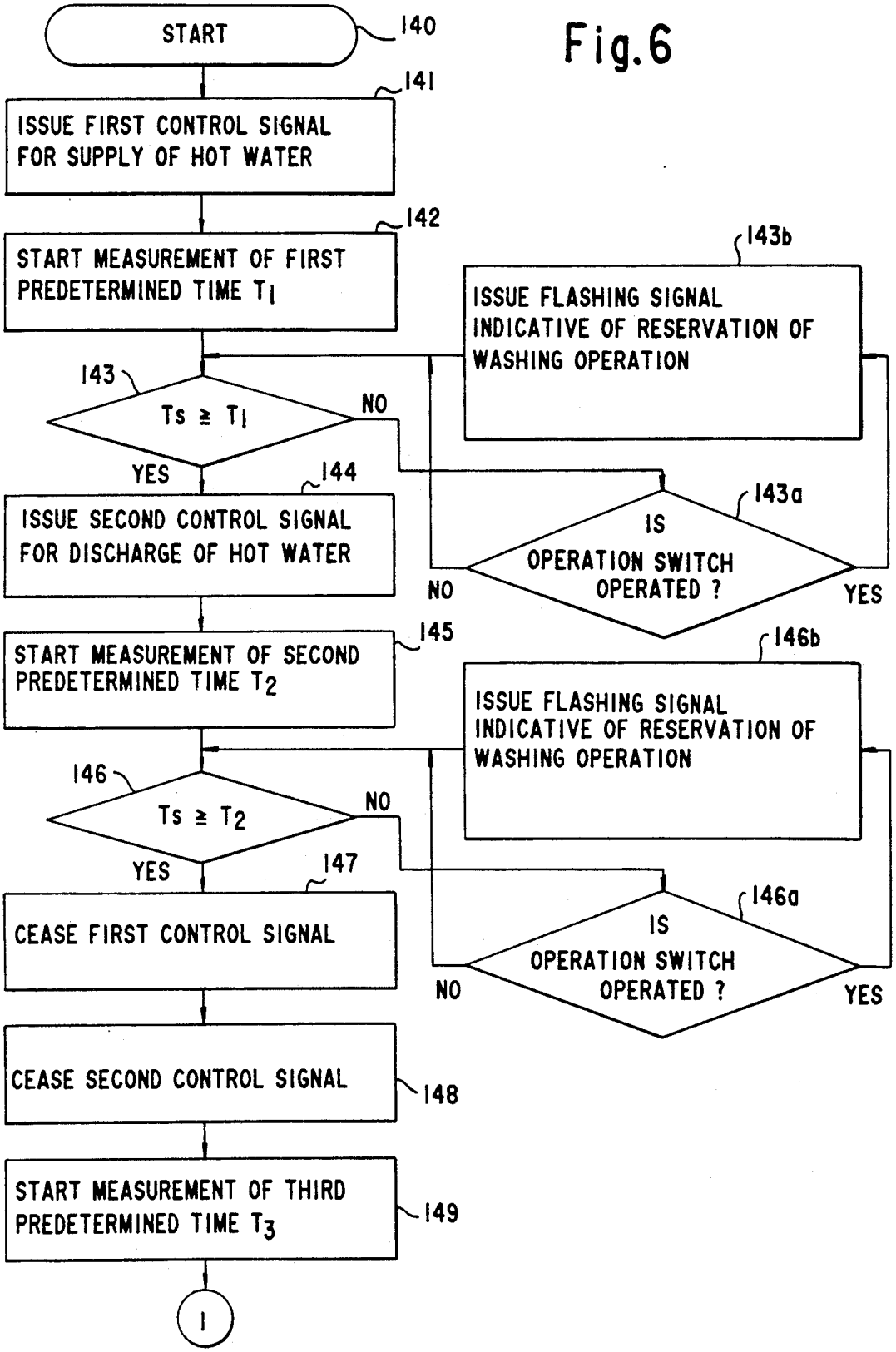
FIGS. 6 and 7 illustrate a control program executed by a microcomputer shown in FIG. 5.
Figure 7:
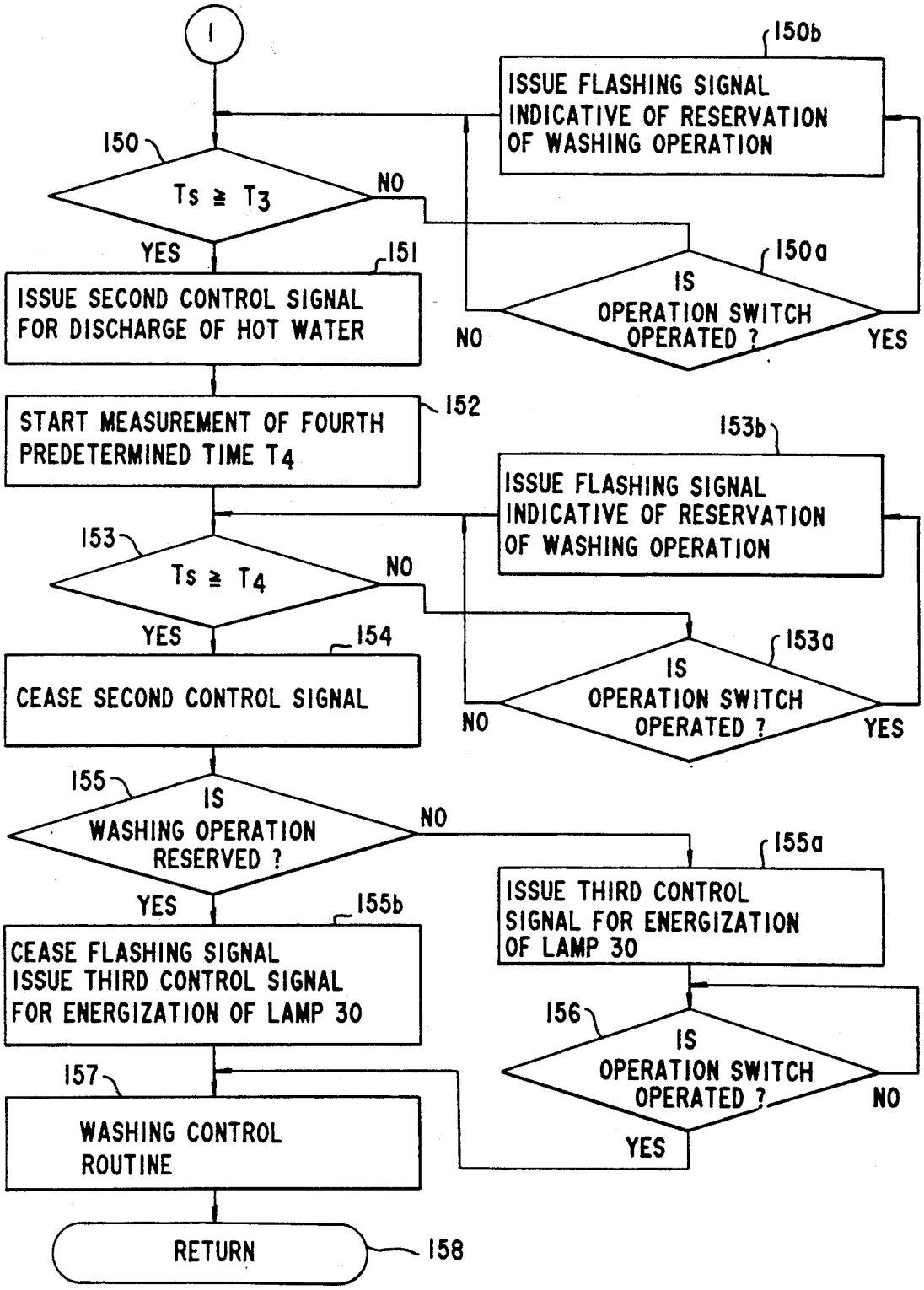

In FIGS. 5 to 7, there is illustrated a modification of the electric control apparatus for the dishwashing machine, wherein the operation switch **10*b* and microcomputer 20 are replaced with an operation switch 10*d* and a microcomputer 20A, respectively. The ROM of computer 20A is arranged to memorize a control program shown by a flow chart in FIGS. 6 and 7. The operation switch 10*d*** is arranged to issue an operation signal therefrom when operated to start or reserve washing operation of the machine. The other construction is substantially the same as that of the above-described embodiment.

Assuming that the power source switch 10*a* has been operated, the computer 20A initiates execution of the control program at step 140 shown in FIG. 6. The computer 20A issues a first control signal for activation of the water supply valve 11 at step 141 and resets a timer provided therein at step 142 to start it for measurement of a first predetermined time $T_1$. When applied with the first control signal, the driving circuit 20*a* energizes the solenoid of water supply valve 11. Thus, the water supply valve 11 is opened by energization of its solenoid to supply hot water from the supply source of hot water G into the washing chamber 12 therethrough. The supplied hot water flows into the wash tank 13 through the filter 13. In this instance, the cold water remained in the water supply pipe $P_1$ is discharged with the supplied hot water and stored in the wash tank 13. When the measurement time $T_s$ of the timer is less than the first predetermined time $T_1$, the computer 20A determines a "No" answer at step 143 and causes the program to proceed to step 143*a*. In this modification, the first predetermined time $T_1$ is memorized in the ROM of computer 20A as a period of time during which the wash tank 13 is filled with the hot water supplied through the washing chamber 12 at this initial stage. If the operation switch 10*d* is not operated, the computer 20A determines a "No" answer at step 143*a* and returns the program to step 143.

Upon lapse of the first predetermined time $T_1$, the computer 20A determines a "Yes" answer at step 143 and causes the program to proceed to step 144. At step 144, the computer 20A issues a second control signal for activation of the discharge pump 16. When applied with the second control signal from the computer, the driving circuit 20*b* energizes the electric motor of the discharge pump 16. Thus, the discharge pump 16 is operated by energization of its electric motor to discharge the hot water from wash pump 13. In this instance, the discharge of hot water is conducted without causing any suction of the air into the discharge pump 16.

After processing at step 144, the computer 20A resets the timer at step 145 to restart it for measurement of a second predetermined time $T_2$. When the measurement time $T_s$ of the timer is less than the second predetermined time $T_2$, the computer 20A determines a "No" answer at step 146 and causes the program to proceed to step 146*a*. If the cperation switch 10*d* is not operated, the computer 20A determines a "No" answer at step 146*a* and returns the program to step 146. Upon lapse of the second predetermined time $T_2$, the computer 20A determines a "Yes" answer at step 146 and causes the program to proceed to step 147. Thus, the computer 20A ceases the issuance of the first control signal at step 147 and ceases the issuance of the second control signal at step 148. In this modification, the second predetermined time $T_2$ is memorized in the ROM of computer 20A as a period of time during which the low temperature hot water mixed with the cold water is discharged from the wash tank 13 to store fresh hot water newly supplied into the wash tank 13 at a high temperature suitable for washing of the tableware D. In response to disappearance of the first and second control signals, the water supply valve 11 is closed by deenergization of its solenoid to interrupt the supply of hot water into the washing chamber 12, and the discharge pump 16 is stopped to maintain the hot water stored in wash tank 13 at the high temperature.

Subsequently, the computer 20A resets the timer at step 149 to restart it for measurement of a third predetermined time $T_3$. During measurement of the third predetermined time $T_3$, the computer 20A determines a "No" answer at step 150 and causes the program to proceed to step 150*a*. If the operation switch 10*d* is not operated, the computer 20A determines a "No" answer at step 150*a* and returns the program to step 150. In this modification, the third predetermined time $T_3$ is memorized in the ROM of computer 20A as a period of time during which the air sucked into the discharge pump 16 during the second predetermined time $T_2$ is exhausted by the hot water supplied into the wash tank 13 before stopping of the discharge pump 16. Upon lapse of the third predetermined time $T_3$, the computer 20A determines a "Yes" answer at step 150 and causes the program to proceed to step 151. At step 151, the computer 20A issues again the second control signal for activation of the discharge pump 16. When applied with the second control signal from computer 20A, the driving circuit 20*b* energizes the electric motor of discharge pump 16. Thus, the discharge pump 16 is operated again by energization of its electric motor to discharge the hot water from wash tank 13 through the discharge pipe. In this instance, the discharge of hot water is smoothly conducted without causing any suction of the air into the discharge pump 16.

After processing at step 151, the computer 20A resets the timer at step 152 to restart it for measurement of a fourth predetermined time $T_4$. During measurement of the fourth predetermined time $T_4$, the computer 20A determines a "No" answer at step 153 and causes the program to proceed to step 153*a*. If the operation switch 10*d* is not operated, the computer 20A determines a "No" answer at step 153*a* and returns the program to step 153. Upon lapse of the fourth predetermined time $T_4$, the computer 20A determines a "Yes" answer at step 153 and causes the program to proceed to step 154. Thus, the computer 20A ceases the issuance of the second control signal at step 154. In response to disappearance of the second control signal, the discharge pump 16 is stopped under control of the driving circuit 20*b*. In this modification, the fourth predetermined time $T_4$ is memorized in the ROM of computer 20A as a period of time during which the low temperature hot water remained in wash tank 13 is completely discharged. Subsequently, the computer 20A determines at step 155 whether the washing operation of the machine is reserved or not. If the operation switch 10*d* is not operated to reserve washing operation of the machine, the computer 20A determines a "No" answer at step 155 and causes the program to proceed to step 155*a*. Thus, the computer 20A issues a third control signal for energization of the indication lamp 30 at step 155*a* and determines at step 156 whether the operation switch 10*d* is operated or not.

When the operation switch 10*d* is operated to start washing operation of the machine, the computer 20A determines a "Yes" answer at step 156 in response to an operation signal from switch 10*d* and causes the program to proceed to a washing control routine 157. During execution of the washing control routine 157, the water supply valve 11 is operated under control of the water level detection switch 10*c* to newly supply fresh hot water into the wash tank 13 from the supply source of hot water G through the washing chamber 12 at the high temperature suitable for washing of the tableware D. In this instance, even if the operation switch 10*d* is operated prior to processing at step 155*a*, the execution of the washing control routine 157 will be prohibited.

If the operation switch 10*d* is operated to reserve washing operation of the machine during execution of the control program, the computer 20A determines a "Yes" answer at step 143*a*, 146*a*, 150*a* or 153*a* and causes the program to proceed to step 143*b*, 146*b*, 150*b* or 153*b*. At step 143*b*, 146*b*, 150*b* or 153*b*, the computer 20A sets the reservation of the washing operation as a reservation data and issues a flashing signal therefrom. When applied with the flashing signal, the indication lamp 30 is intermittently lighted to inform the user of the reservation of the washing operation. When the program proceeds to step 155 in the same manner as described above, the computer 20A determines a "Yes" answer and causes the program to proceed to step 155*b*. At step 155*b*, the computer 20A ceases the issuance of the flashing signal and issues the third control signal for energization of the indication lamp 30. Subsequently, the computer 20A causes the program to proceed to step 157 for execution of the washing control routine. Thus, the washing operation of the machine is automatically started by execution of the washing control routine, and the indication lamp 30 is lighted in response to the third control signal to inform the user of the washing operation of the machine.

From the above description, it will be understood that when the operation switch 10*d* is previously operated to reserve washing operation of the machine during execution of the control program, the washing operation of the machine is automatically started even if the user left from the machine for urgent work. In a practical embodiment of the present invention, the operation switch 10*d* may be replaced with first, second and third operation switches respectively for rinsing, standard washing and powerful washing. In such a case, the control program is modified to determine operation of the replaced operation switches respectively at step 143*a*, 146*a* and 150*a* or 153*a* and to reserve rinsing, standard washing and powerful washing modes respectively at step 143*b*, 146*b* and 150*b* or 153*b*. In addition, the step 155*a* and 156 may be eliminated in such a manner that the program proceeds to step 158 when a "No" answer is determined by the computer at step 155. In such a case, the washing operation of the machine is conducted only when it has been reserved by operation of the operation switch 10*d*.

Having now fully set forth certain preferred embodiments of the concept underlying the present invention, various other embodiments as well as certain modifications of the embodiments herein shown and described will obviously occur to those skilled in the art upon becoming familiar with said underlying concept. It is to be understood, therefore, that within the scope of the appended claims, the invention may be practiced otherwise than as specifically set forth herein.

What is claimed is:

1. An electric control apparatus for a dishwashing machine having a washing chamber, a water supply pipe arranged to supply hot water from a supply source of hot water into the washing chamber, an electrically operated water supply valve disposed within the water supply pipe to permit the supply of hot water into the washing chamber therethrough when activated, a wash tank arranged to be supplied with the hot water through the washing chamber, a wash pump arranged to pump up the hot water from the wash tank when activated, a revolving wash arm arranged within the washing chamber to direct jet streams of the hot water supplied from the wash pump to a rack of tableware placed in the washing chamber, and a discharge pump arranged to discharge the hot water from the wash tank when activated, comprising:

a power source switch;

means for successively measuring first, second, third and fourth predetermined times in response to operation of said power source switch;

means for activating said water supply valve in response to operation of said power source switch to supply hot water into said wash tank from said supply source of hot water through said water supply pipe and said washing chamber and maintaining the supply of hot water into said water tank during the first and second predetermined times;

means for activating said discharge pump upon lapse of the first predetermined time to discharge the hot water from said wash tank during the second predetermined time;

means for deactivating said water supply valve and said discharge pump upon lapse of the second predetermined time and maintaining said water supply valve and said discharge pump at their deactivated conditions during the third predetermined time; and means for activating said discharge pump upon lapse of the third predetermined time to discharge the hot water from said wash tank during the fourth predetermined time and deactivating said discharge pump upon lapse of the fourth predetermined time.

2. An electric control apparatus for a dishwashing machine as claimed in claim 1, further comprising an operation switch arranged to issue an operation signal therefrom when operated to start washing operation of the dishwashing machine and means responsive to the operation signal from said operation switch for starting the washing operation of the machine upon lapse of the fourth predetermined time.

3. An electric control apparatus for a dishwashing machine as claimed in claim 1, further comprising an operation switch arranged to issue an operation signal therefrom when operated to reserve washing operation of the dishwashing machine in the course of lapse of the first, second or third predetermined time and means responsive to the operation signal from said operation switch for automatically starting the washing operation of the machine upon lapse of the fourth predetermined time.

* * * * *